United States Patent [19]

Teach

[11] 3,997,071

[45] Dec. 14, 1976

[54] METHOD AND APPARATUS FOR INDICATING EFFECTIVE DIGGING DEPTH OF A BACKHOE

[75] Inventor: Ted L. Teach, Dayton, Ohio

[73] Assignee: Laserplane Corporation, Dayton, Ohio

[22] Filed: Aug. 14, 1975

[21] Appl. No.: 604,665

[52] U.S. Cl. ..... 214/761; 37/DIG. 19; 212/39 MS; 235/186; 340/267 C

[51] Int. Cl.[2] ..... G08B 5/22; E02F 9/26

[58] Field of Search ..... 214/138 R, 152, 761; 37/DIG. 1, DIG. 19; 172/4, 4.5; 33/1 H, 1 MP; 212/39 A, 39 MS; 235/186, 189; 73/67.8 S; 340/267 C

[56] References Cited

UNITED STATES PATENTS

| | | | |
|---|---|---|---|
| 3,346,724 | 10/1967 | Fuhrmeister et al. | 33/1 MP X |
| 3,347,398 | 10/1967 | Smith | 214/761 X |
| 3,505,514 | 4/1970 | Fathauer | 235/189 |
| 3,549,876 | 12/1970 | Hamilton | 235/186 |
| 3,819,922 | 6/1974 | Horn et al. | 212/394 X |
| 3,825,808 | 7/1974 | Leach | 318/468 X |
| 3,833,932 | 9/1974 | Hamilton | 340/267 C |
| 3,924,452 | 12/1975 | Meyer et al. | 73/67.8 S |
| 3,932,855 | 1/1976 | Hamilton | 340/267 C |

*Primary Examiner*—L. J. Paperner

[57] ABSTRACT

In a backhoe of the type having an outreach boom horizontally pivotally mounted relative to a vehicle, a downreach boom horizontally pivotally mounted to the free end of the outreach boom, and a digging bucket horizontally pivotally mounted to the free end of the downreach boom, apparatus is provided for respectively generating signals proportional to the angle between the outreach boom and the horizontal, the angle between the outreach boom and the downreach boom, and the angle between the downreach boom and a line drawn to the digging teeth of the bucket. Such signals are combined according to a trigonometric equation to provide a continuous signal and visual indication proportional to the depth of the digging teeth of the bucket relative to the horizontal pivotal mounting axis of the outreach boom on the vehicle. In accordance with a modification, the absolute elevation of the digging teeth of the backhoe bucket is determined and indicated by measuring the absolute elevation of the pivotal mounting axis of the outreach boom relative to a reference plane defined by a rotating laser beam.

2 Claims, 5 Drawing Figures

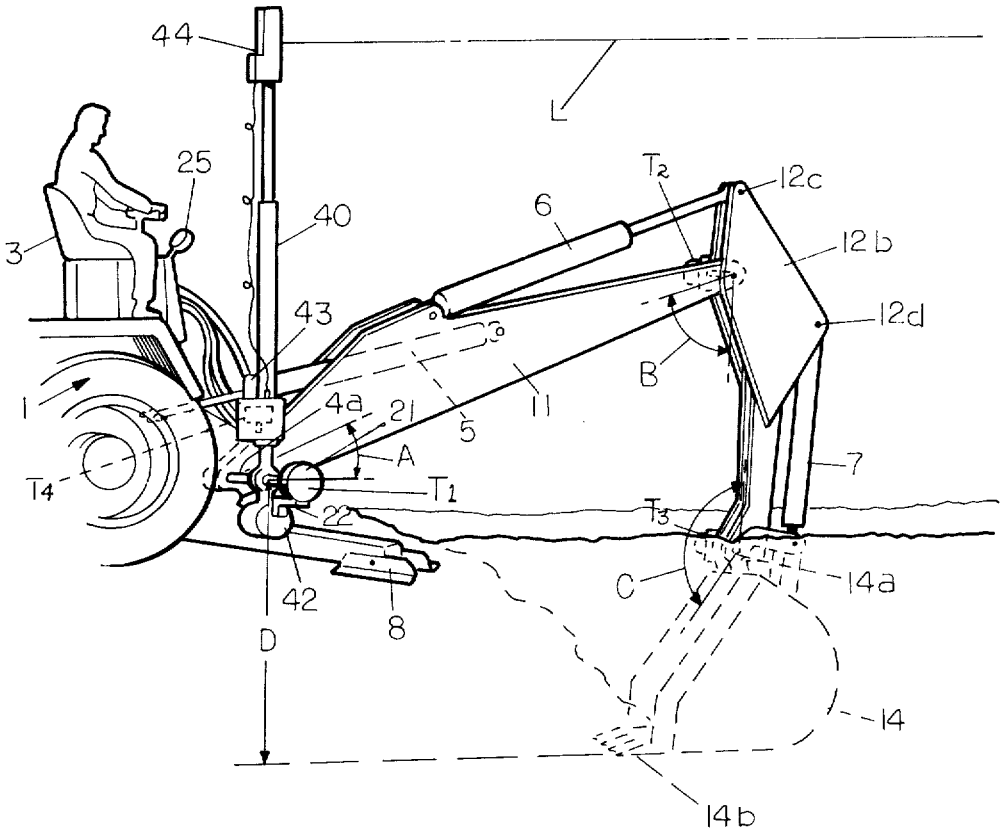
FIG. 2
FIG. 3
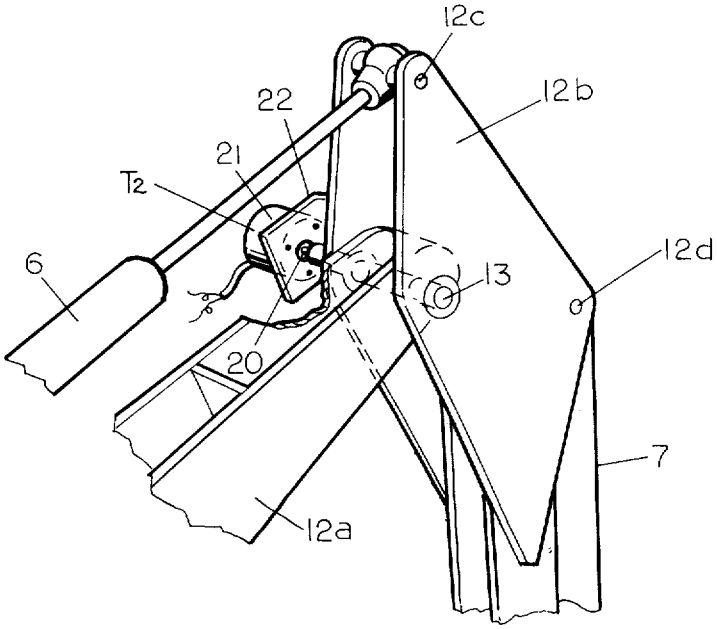

METHOD AND APPARATUS FOR INDICATING EFFECTIVE DIGGING DEPTH OF A BACKHOE

BACKGROUND OF THE INVENTION

In recent years, backhoes have become very popular implements in the construction trade for digging all types of minor excavations which do not warrant the moving of a conventional shovel-type digger or dragline to the working area. Additionally, such backhoe assemblies are normally carried on the rear portion of a farm or industrial tractor and the tractor is available for other uses, for example, a dozer blade or a front end loader may be mounted on the forward portions of the tractor.

Despite the obvious need for the operator to know at all times the effective depth of the excavation that he is producing, prior to this invention there have been no reliable instruments provided for continuously indicating to the operator the effective digging depth of the teeth of the backhoe bucket. The absence of such an indicating system is understandable when one considers that the depth of such digging teeth is determined by a plurality of variables, namely, the angle of the outreach boom relative to the vehicle or the horizontal, the angle of the downreach boom relative to the outreach boom, and the angle of the bucket relative to the downreach boom. As a practical matter, for the bucket teeth to move horizontally at a constant depth, at least two (2) of said angles must be concurrently varied. Furthermore, in some excavations, such for example as required for installation of sewer or drain lines, the absolute depth of the excavation must be precisely determined and, prior to the development of this invention, such absolute depth could only be determined by inserting an elongated surveyors rod into the trench and measuring the depth by conventional, yet time consuming, surveying techniques.

OBJECTS OF THE INVENTION

Accordingly, it is an object of this invention to provide a method and apparatus for continuously indicating the effective digging depth of the digging teeth of a backhoe bucket.

A further object of the invention is to provide apparatus for continuously generating electrical signals respectively proportional to the angle of the outreach boom of a backhoe with respect to the horizontal, the angle between the outreach boom and the downreach boom, and the effective angle between the downreach boom and the digging teeth of the backhoe bucket, and for combining said electrical signals according to a trigonometric relationship to provide a signal continuously indicating the effective depth of the teeth of the backhoe bucket.

A particular object of the invention is to provide apparatus for combining a signal proportional to the cutting depth of the teeth of the backhoe bucket relative to the pivotal mounting axis of the outreach beam on the vehicle with a signal proportional to the absolute elevation of said pivotal axis as determined by its vertical displacement with respect to a reference plane defined by a rotating laser beam.

Further objects and advantages of the invention will become apparent to those skilled in the art from the following detailed description, taken in conjunction with the annexed sheets of drawings.

DESCRIPTION OF DRAWINGS

FIG. 2 is a view similar to FIG. 1 but showing the backhoe bucket in a digging position relative to the ground.

FIG. 3 is an enlarged scale perspective view of a portion of FIG. 2 showing the mounting of the downreach boom relative to the outreach boom and the placement of the transducer by which the effective angle between said booms is continuously indicated.

DESCRIPTION OF INVENTION

Figure 1:
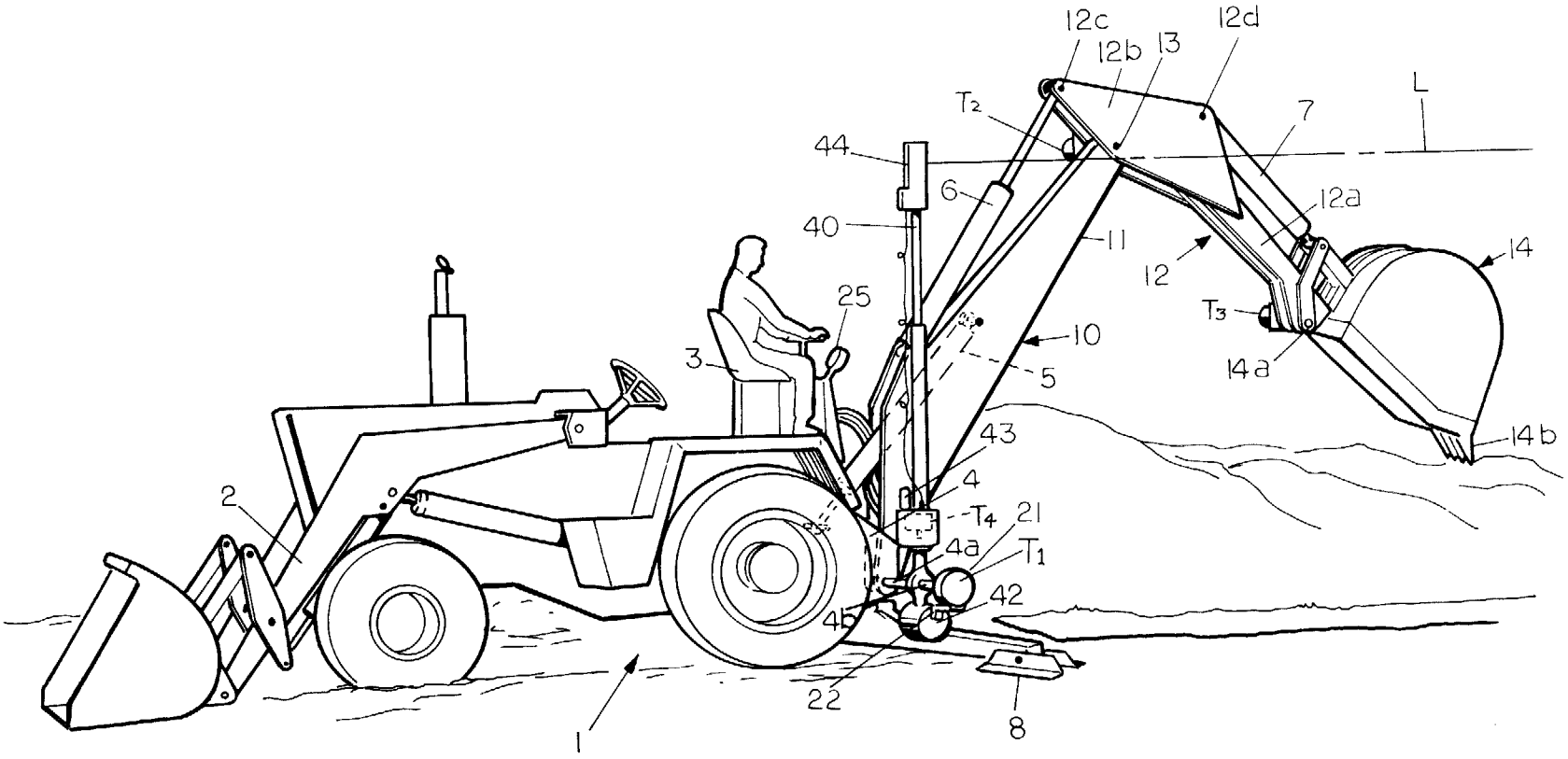
FIG. 1 is a perspective view of a common form of a backhoe mounted on an industrial tractor and embodying the digging depth indicating apparatus embodying this invention.

Referring to FIG. 1, there is shown an industrial type tractor 1 having a conventional backhoe assemblage 10 mounted on the rear portion of the backhoe. Said tractor 1 may also carry a front end loader 1 on its forward portions and the operators seat 3 is swiveled so as to permit the operator to face forwardly when operating the front end loader and rearwardly when operating the backhoe.

As is well known in the backhoe art, such backhoes comprise an outreach boom 11 formed by two (2) spaced triangular plate members suitably secured together by weldments to form a rigid truss element. The forward end of outreach boom 11 is appropriately secured to a transverse shaft 4*a* journalled by a mounting bracket 4. Bracket 4 is pivotally mounted to vehicle 1 for horizontal swinging movement by conventional means (not shown). Hydraulic cylinder 5 operates between the bracket 4 and the outreach boom 11 to control the vertical pivotal position of said outreach boom 11 relative to the vehicle. A pair of laterally projecting stabilizing pads 8 are also attached to vehicle 1 in conventional fashion.

At the free end of the outreach boom 11, a downreach boom 12 is pivotally mounted by a horizontal pin 13. Downreach boom 12 comprises a main structural frame element 12*a* to which a pair of generally triangular plates 12*b* are respectively secured by welding in opposed relationship. The plates 12*b* are traversed by the mounting pin 13 and also support a pivotal mounting pin 12*c* which receives the end of a cylinder unit 6 which operates between the outreach boom 11 and the downreach boom 12 to control the relative angular positions of said booms. A third pivot mounting pin 12*d* provides a pivotal mounting for a cylinder unit 7 which controls the pivotal position of a digging bucket 14 which is pivotally mounted to the free end of the downreach boom 12 as by pivot pin 14*a*. Bucket 14 is of conventional configuration and has digging teeth 14*b* at its extreme lower edge. Obviously, it is the vertical position or depth of the digging teeth 14*b* that determines the effective digging depth of the bucket 14.

Each of the cylinders 5, 6 and 7 respectively controlling the position of the outreach boom 11 relative to the vehicle, the pivotal position of the downreach boom 12 relative to the outreach boom 11, and the position of the bucket 14 with respect to the end of the downreach boom 12, is normally manually controlled by conventional individual hydraulic controls positioned immediately behind the operator's seat 3 on the vehicle 1. By varying the relative angle of the outreach boom 11 with respect to the vehicle, the digging bucket may be positioned in an inoperative position as shown in FIG. 1 above the ground or, as shown in FIG. 2, moved to a digging position beneath the ground. The path of the digging bucket through the ground is obviously controlled by the operator by making the appropriate variations of the relative angles between the outreach boom 11, the downreach boom 12 and the digging bucket 14.

At each of the major pivotal axes involved in the operation of the backhoe, a transducer T1, T1 and T3 is mounted. Transducers T1, T2 and T3 are of a conventional type which produce an electrical signal proportional to the angular displacement of the shaft 20 (FIG. 3) relative to the circular body 21 of the transducer. For example, the transducer may be the type manufactured and sold by Trans-Tek Inc. of Ellington, Conn. Shaft 20 of transducer T1 is suitably co-axially secured to an extension 4*b* of the pivot mounting shaft 4*a*. The shaft 20 of transducer T2 is suitably secured to the pin 13 by which the downreach boom 12 is pivotally secured to the outreach boom 11. Lastly, the shaft (not shown) of transducer T3 is secured to the pivot shaft 14*a* by which the digging bucket 14 is pivotally secured to the end of the downreach boom 12. Suitable brackets 22 are provided for mounting the cylindrical body portions 21 of each of the transducers T1, T2 and T3 so that any movement of the respective booms produces a movement of the shaft 20 relative to the body portion 21 of the particular transducer mounted at such pivotal axis. Bracket 22 of transducer T1 is secured to penduluum 42 to produce a signal proportional to the angle A between the boom 11 and the horizontal.

Figure 4:
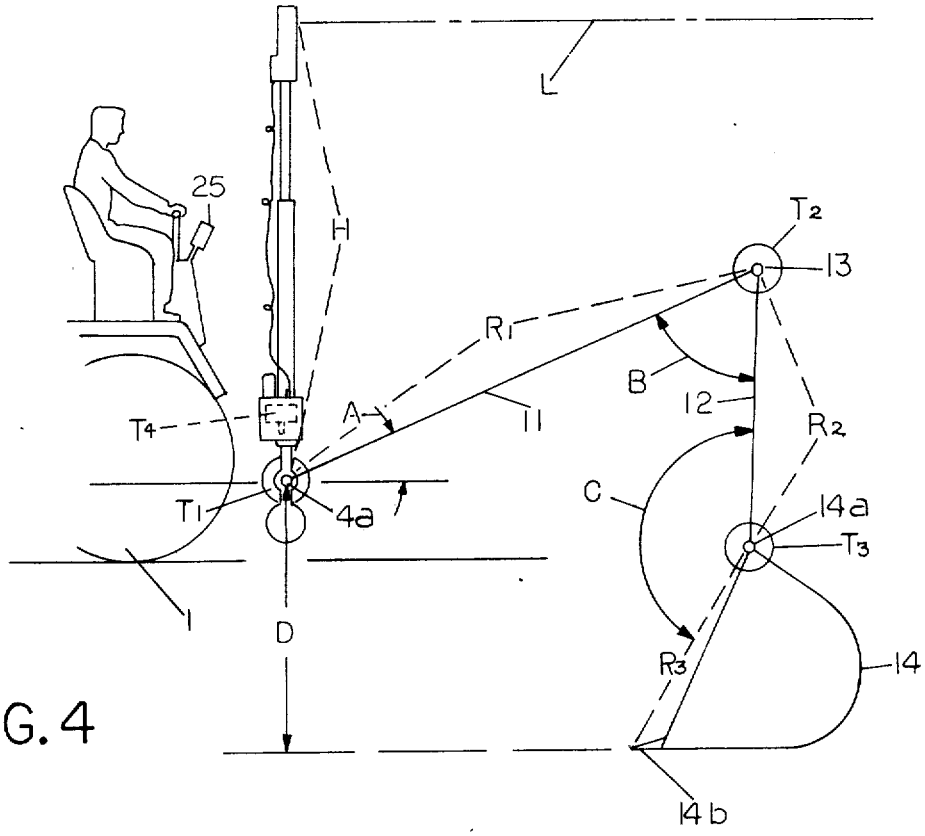
FIG. 4 is a schematic representation of the movable elements of the backhoe for purposes of trigonometric analysis of the position of the cutting teeth of the backhoe.

Referring now to the simplified diagram of the backhoe shown in FIG. 4, the distance R1 represents the effective length of the outreach boom 11 between the pivot mounting pins 4*a* and 13. The distance R2 is the effective length of the downreach boom 12 between the pivot pins 13 and 14*a*. Lastly, the distance R3 is the effective distance from the pivot mounting pin 14*a* by which the digging bucket is secured to the downreach boom to the end of the digging teeth 14*b*. The angle A is the angle between the outreach boom 11 and the horizontal, the angle B is the angle between the outreach boom 11 and the downreach boom 12 and the angle C is the effective angle between the downreach boom 12 and the line R3 drawn between the digging teeth and the pivot mounting axis 14*a* of the bucket 14.

By applying conventional trigonometric analysis, the distance D between the pivot axis 4*a* provided on the vehicle for mounting the outreach boom 11 and the digging depth of the teeth 14*b* of the bucket 14 may be found to be determined by the following equation:

$$D = R1 \sin A - R2 \sin (A \text{ plus } B) \text{ plus } R3 \sin (A \text{ plus } B \text{ plus } C).$$

It necessarily follows that if electrical signals can be generated which are respectively proportional to R1, R2 and R3, angle A, angle B, angle C, and sin A, sin (A plus B), and sin (A plus B plus C) then an electrical signal proportional to the depth D may be developed. Since R1, R2 and R3 are known constants, there is no problem in producing an electrical signal proportional to such constants. The transducers T1, T2 and T3 will respectively provide electrical signals proportional to the angle A, the angle B, and the angle C. Lastly, devices 26 (FIG. 5) are known in the art for producing signals proportional to a trigonometric function of a input signal. Such device, for example, may comprise the model 435 Analog Operator manufactured and sold by Bell and Howell, Inc. of Bridgeport, Conn. Therefore, by the use of such devices, it is possible to obtain electrical signals respectively proportional to sin A, sin (A plus B), and sin (A plus B plus C).

Figure 5:
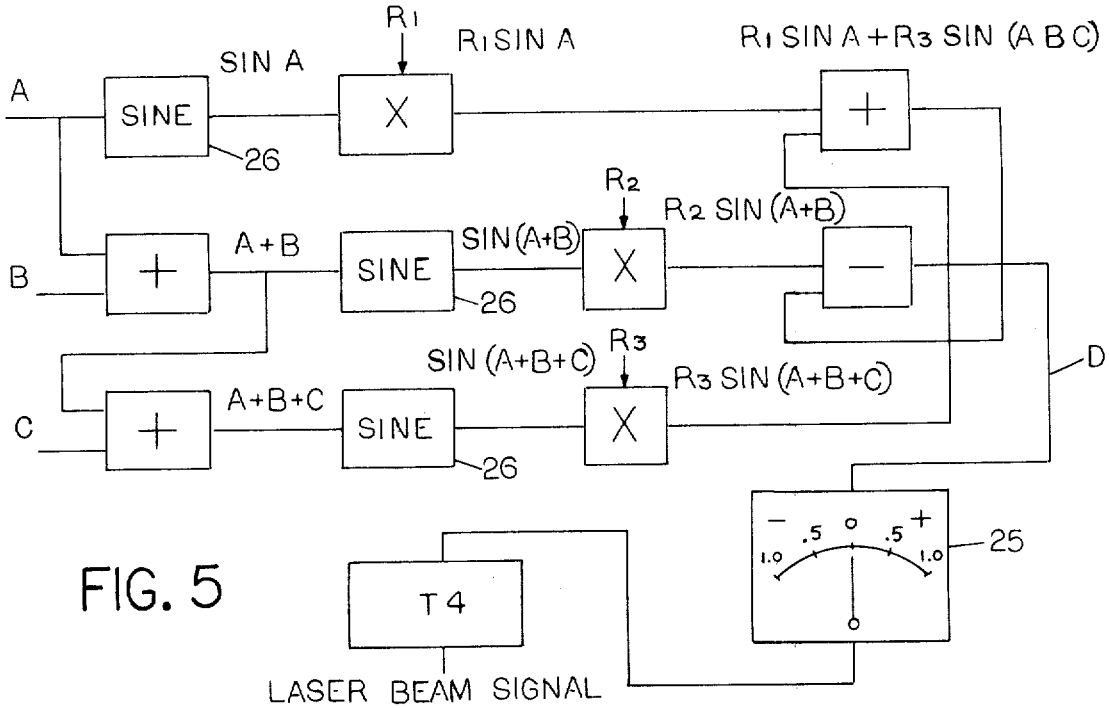
FIG. 5 is a schematic circuit diagram illustrating how the various signals generated by the transducers placed on the backhoes are combined to provide a signal indicating the effective digging depth of the backhoe bucket.

Accordingly, appropriate electrical circuitry is set up as illustrated in FIG. 5 to effect the combination of signals proportional to R1, R2, R3, sin A, sin (A plus B) and sin (A plus B plus C) resulting in an electrical signal proportional to D which is the distance from the pivot axis 4*a* on the vehicle bracket 4 to the digging teeth 14*b* of the backhoe bucket 14. This signal may be read on an appropriate ammeter or voltmeter 25 which is calibrated in appropriate units.

As is well known to operators of backhoes, the vertical height of the pivot axis of the backhoe may very well shift during the digging operation due to the weight of the vehicle effecting a settling of the vehicle support pads 8. Accordingly, if it is desired to know in absolute terms the working depth of the teeth 14*b* of the backhoe bucket, then it is necessary to know the absolute height of the pivot axis 4*a* with respect to a horizontal reference plane. Referring to FIGS. 1 and 2, such reference plane may be defined by a laser beam L which is periodically swept over the area. The apparatus for generating such rotating laser beam may be that disclosed in Studebaker patent, U.S. Pat. No. 3,588,249.

To detect the reference plane defined by the laser beam L, an upstanding mast 40 is provided constituting an extension of penduluum 42 having the bottom end thereof pivotally mounted on extension 4*b* of the pivot pin 4 *a* which mounts the outreach boom 11 to the bracket 4. Mast 40 is supported in a true vertical position by the penduluum weight 42 positioned below the pivot mounting pin 4*b*. Mast 40 may be identical to that disclosed in my earlier U.S. Pat. No. 3,825,808 and incorporates a motor 43 for extending or contracting the vertical height of mast 40. At the top of mast 40, a laser beam sensor unit 44 is mounted comprising a plurality of vertically stacked cells (not shown) which generate electrical signals when impinged by the laser beam L. The same circuitry as described in my prior U.S. Pat. No. 3,825,808 may be employed to automatically effect the raising or lowering of mast 40 through the operation of the motor 43 to keep the center of the vertically stacked array of laser beam receiving cells in exact alignment with the reference plane defined by the laser beam L. The resulting vertical movements of the mast 40 may be translated into a rotational movement as described in said patent and such rotational movement detected by a transducer T4 (FIGS. 4 and 5) thus producing an electrical signal proportional to the height of the mast 40, hence proportional to the absolute vertical spacing H (FIG. 4) between the pivot axis 4*a* and the reference plane defined by the laser beam L. As shown in FIG. 5, the signal from transducer T4 may be added to the signal D and thus the indicating instrument 25 will now indicate the absolute elevation, or displacement of the cutting teeth 14*b* of the backhoe bucket relative to the reference plane defined by the laser beam L.

The advantages of the above described method and apparatus for determining the depth of the cutting teeth of a backhoe bucket to the operator are readily apparent. Without leaving his seat, he can dig an excavation precisely to a desired depth without any surveying activities. The only thing that need be done is to have the rotating laser beam transmitter set up to sweep the working area with the laser beam L at a known height. The resulting electrical signals applied to the instrument 25, which may be positioned adjacent the operators station 3, will provide him with an indication of the effective depth in foot and tenth of a foot units of the cutting teeth 14*b* of the backhoe bucket 14.

Modifications of this invention will obviously be apparent to those skilled in the art and it is intended to include all such modifications within the scope of the appended claims.

I claim:

1. Apparatus for indicating the working depth of the digging edge of the bucket of a backhoe, said backhoe being the type having an outreach boom horizontally pivotally attached at one end to a vehicle, a downreach boom horizontally pivotally attached to the free end of the outreach boom, a digging bucket horizontally pivotally attached to the free end of the downreach boom and power means for producing relative pivotal movements of all said pivotally inter-connected elements, comprising, in combination:

1. electrical means for generating signals respectively proportional to:
   a. the angle A between the outreach boom and the horizontal;
   b. the angle B between the outreach boom and the downreach boom;
   c. the angle C between the downreach boom and the digging edge of the bucket;
   d. the distance R1 between the two pivot axes on the outreach boom;
   e. the distance R2 between the pivot axes of the downreach boom; and
   f. the distance R3 between the pivot axis of the digging bucket and the digging edge of the bucket;
2. second electrical means for generating signals respectively proportional to sinA, sin (A plus B), and sin (A plus B plus C);
3. third electrical means for combining said aforementioned signals to produce a signal D according to the following equation:

$$D = R1 \sin(A) \text{ minus } R2 \sin(A \text{ plus } B) \text{ plus } R3 \sin(A \text{ plus } B \text{ plus } C);$$

and 4. means for indicating signal D in distance units thereby indicating the depth of the bucket digging edge relative to the pivotal mounting axis of the outreach boom on the vehicle.

2. The combination defined in claim 1, plus means for periodically sweeping a laser beam over the working area where the backhoe is located, said beam defining a reference plane of known height, an upstanding mast mounted on said backhoe, laser beam sensor means mounted on the top portion of said mast, power means for raising and lowering said mast, control circuit means responsive to said sensor means and controlling said power means to maintain said sensor means in the same elevational position relative to said reference plane irrespective of the variations in elevation of the backhoe vehicle, means for generating an electrical signal responsive to the raising and lowering movements of said mast, and means for combining that last mentioned signal with the signal D to provide an indication of the cutting depth of the backhoe bucket relative to said reference plane.

* * * * *